US008141268B2

(12) United States Patent
Vezina et al.

(10) Patent No.: US 8,141,268 B2
(45) Date of Patent: Mar. 27, 2012

(54) COLLAPSIBLE DRYING BAG

(76) Inventors: Jean-François Vezina, Trois-Rivières (CA); Pierrot Lebel, Trois-Rivières (CA)

( * ) Notice: Subject to any disclaimer, the term of this patent is extended or adjusted under 35 U.S.C. 154(b) by 315 days.

(21) Appl. No.: 12/646,527

(22) Filed: Dec. 23, 2009

(65) Prior Publication Data

US 2011/0146098 A1 Jun. 23, 2011

(51) Int. Cl.
*F26B 11/02* (2006.01)

(52) U.S. Cl. ..... 34/104; 34/90; 34/201; 34/210; 34/218; 219/521; 219/385; D6/320; 422/294; 422/292; 211/85.7; 211/38; 392/486

(58) Field of Classification Search ..... 34/60, 90, 34/104, 105, 201, 210, 218, 235; D6/320; 211/85.7, 38; 422/292, 294; 219/521, 385; 392/486

See application file for complete search history.

(56) References Cited

U.S. PATENT DOCUMENTS

| | | | | | |
|---|---|---|---|---|---|
| 2,975,529 | A | * | 3/1961 | Weber | 34/622 |
| 3,432,939 | A | * | 3/1969 | Eichholz | 34/622 |
| 3,513,564 | A | | 5/1970 | Grampire | |
| 3,577,650 | A | * | 5/1971 | Brahm | 34/622 |
| 3,626,602 | A | * | 12/1971 | Glowacki | 34/622 |
| 3,835,552 | A | * | 9/1974 | Lord | 34/621 |
| 3,858,331 | A | * | 1/1975 | Lord | 34/621 |
| 4,593,841 | A | * | 6/1986 | Lange | 224/153 |
| 4,625,432 | A | * | 12/1986 | Baltes | 34/621 |
| 4,777,737 | A | * | 10/1988 | Wolens et al. | 34/237 |
| 5,369,892 | A | | 12/1994 | Dhaemers | |
| 5,490,712 | A | | 2/1996 | Drelick | |
| 5,528,840 | A | * | 6/1996 | Pajak et al. | 34/622 |
| 5,546,678 | A | | 8/1996 | Dhaemers | |
| RE35,834 | E | * | 7/1998 | Miller | 219/521 |
| 5,816,417 | A | * | 10/1998 | Reaves | 211/119.01 |
| 5,833,083 | A | * | 11/1998 | Miller | 211/134 |
| 5,930,915 | A | * | 8/1999 | Dhaemers | 34/511 |
| 6,327,792 | B1 | | 12/2001 | Hebert | |
| 6,780,101 | B2 | * | 8/2004 | Buhler et al. | 34/437 |
| 6,860,032 | B2 | | 3/2005 | Meyer | |
| 6,880,711 | B2 | | 4/2005 | Collier | |
| 7,083,055 | B1 | | 8/2006 | Ambrosat | |
| 7,328,780 | B2 | | 2/2008 | Hawthorne | |
| 7,481,065 | B2 | | 1/2009 | Krieger | |
| D644,383 | S | * | 8/2011 | Mangano | D32/8 |
| 8,038,963 | B1 | * | 10/2011 | Chen | 422/294 |
| 2007/0187345 | A1 | * | 8/2007 | Hought | 211/85.11 |
| 2009/0113753 | A1 | * | 5/2009 | Pepper et al. | 34/284 |
| 2009/0134104 | A1 | * | 5/2009 | Victory et al. | 211/180 |
| 2011/0114577 | A1 | * | 5/2011 | Denike | 211/49.1 |
| 2011/0146098 | A1 | * | 6/2011 | Vezina et al. | 34/60 |

FOREIGN PATENT DOCUMENTS

| | | | |
|---|---|---|---|
| CA | 2091612 | | 9/1994 |
| CA | 2241524 | | 12/1998 |
| CA | 2295511 | | 1/1999 |
| CA | 2205607 | | 2/2000 |
| CA | 2314815 | | 2/2001 |
| CA | 2541447 | | 9/2007 |
| EP | 627519 | A1 * | 12/1994 |

* cited by examiner

*Primary Examiner* — Stephen M. Gravini
(74) *Attorney, Agent, or Firm* — Benoît & Côté

(57) ABSTRACT

The present document describes a bag for storing and drying garments or sports equipment. The bag comprises an external envelope substantially made of flexible resistant material. The bag further comprises a frame supporting the external envelope and comprising frame sections capable of adopting a retracted position and an extended position in which the frame occupies more space than in the retracted position. The bag further comprises a tubular structure for hanging the garments or sports equipment and through which air can be blown for drying the hung garments or sports equipment. The tubular structure is mounted on the frame and comprises tube sections capable of adopting a retracted position and an extended position in which the tubular structure occupies more space than in the retracted position.

16 Claims, 4 Drawing Sheets

COLLAPSIBLE DRYING BAG

CROSS-REFERENCE TO RELATED APPLICATIONS

This application is the first disclosure of this subject matter.

TECHNICAL FIELD

This description relates to the field of bags. More particularly, this description relates to bags for storing and drying garments or sports equipment.

BACKGROUND

Sports players often find themselves away from home for extended periods of time and do not have an easy means of drying their equipment. Between sports event away from home, most often the equipment remains wet in a close bag. At best, bags are left open or have mesh portion letting humidity slowly exit the bag.

There is therefore a need for improved bags in which drying of equipment will be improved.

SUMMARY

According to an embodiment, there is provided a bag for storing and drying garments or sports equipment. The bag comprising: an external envelope substantially made of flexible resistant material; a frame supporting the external envelope and comprising frame sections capable of adopting a retracted position and an extended position in which the frame occupies more space than in the retracted position; and a tubular structure for hanging the garments or sports equipment and through which air can be blown for drying the hung garments or sports equipment, the tubular structure being mounted on the frame and comprising tube sections capable of adopting a retracted position and an extended position in which the tubular structure occupies more space than in the retracted position.

According to an embodiment, the tubular structure of the bag above comprises an air input and a plurality of air outputs for blowing air on the garments or sports equipment.

According to an embodiment, the bag above further comprises a blower mounted to the frame and connected to the air input of the tubular structure for providing the blown air.

According to an embodiment, the bag above further comprises a controller electrically connected to the blower for controlling at least one of air pressure and air temperature.

According to an embodiment, the external envelope of the bag above comprises an air entry port for providing fresh air to the blower.

According to an embodiment, the bag above further comprises a battery pack mounted to the frame for providing electrical power to the blower.

According to an embodiment, the bag above further comprises an electrical cord for connecting the blower to an electrical outlet for providing electrical power to the blower.

According to an embodiment, the frame of the bag above comprises a U-shaped arm at an upper end thereof for providing additional support to the external envelope.

According to an embodiment, the frame sections of the bag above are capable of at least one of: collapsing into or along each other and folding toward each other thereby changing the space occupied by the frame.

According to an embodiment, the tube sections of the bag above are capable of at least one of: collapsing into or along each other and folding toward each other thereby changing the space occupied by the tubular structure.

According to an embodiment, the bag above further comprises wheels mounted to the frame.

According to an embodiment, the bag above further comprises a handle mounted to one of the frame and the external envelope at a portion of the bag substantially opposite the wheels to facilitate moving of the bag.

According to an embodiment, the bag above further comprises a disinfectant dispenser for dispensing a disinfectant composition to the garments or sports equipment.

According to an embodiment, the disinfectant dispenser of the bag above is adapted to dispense the disinfectant composition through the tubular structure.

According to an embodiment, the bag above further comprises an odor dispenser for dispensing an odoriferous composition to the garments or sports equipment.

According to an embodiment, the odor dispenser of the bag above is adapted to dispense the odoriferous composition through the tubular structure.

BRIEF DESCRIPTION OF THE DRAWINGS

Further features and advantages of the present disclosure will become apparent from the following detailed description, taken in combination with the appended drawings, in which.

It will be noted that throughout the appended drawings, like features are identified by like reference numerals.

DETAILED DESCRIPTION

Figure 1:
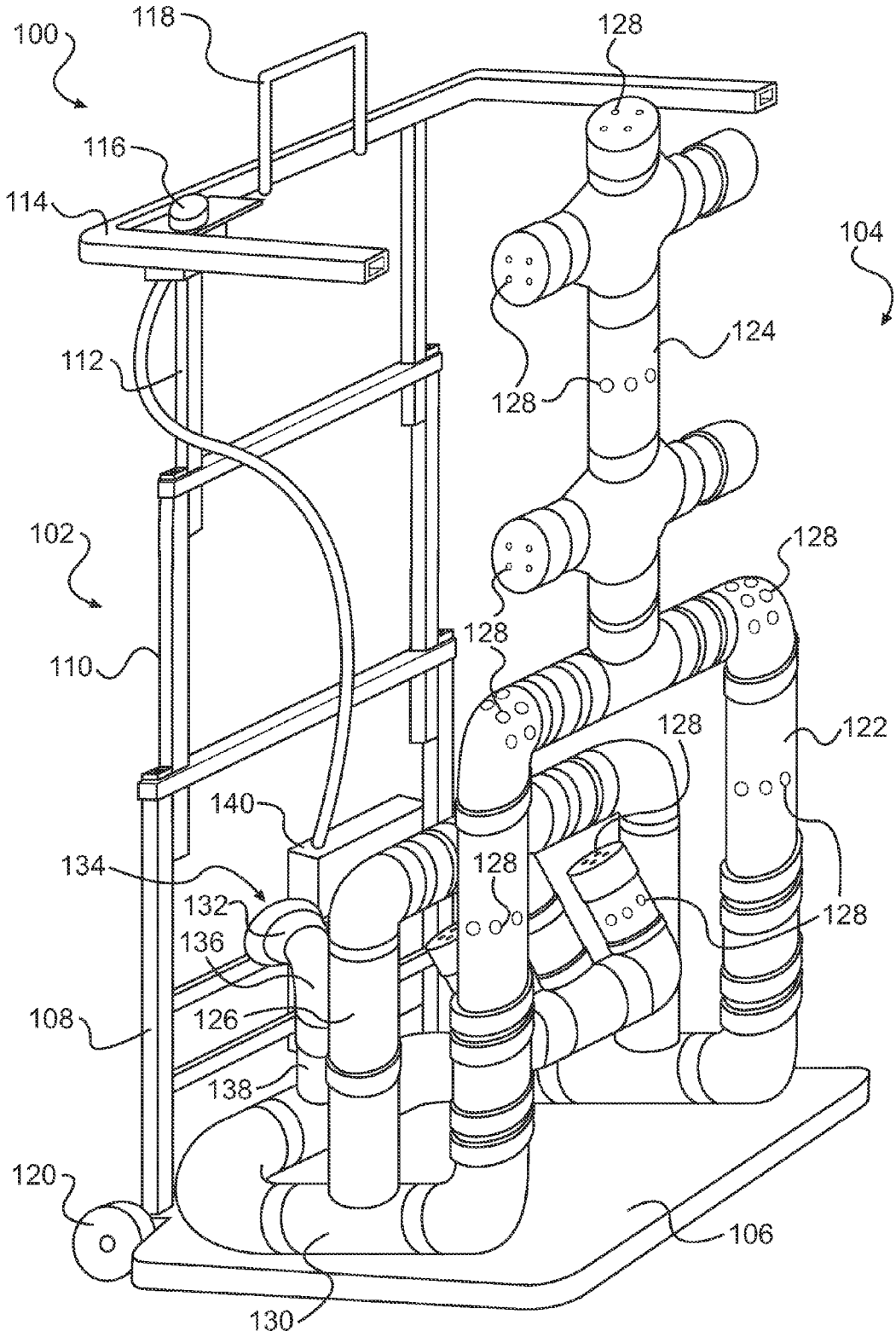
FIG. 1 is a perspective view of an internal structure of a bag in an extended position in accordance with an embodiment.

Referring now to the drawings, and more particularly to FIG. 1, a perspective view of an internal structure 100 of a bag is shown according to an embodiment. The internal structure 100 comprises a frame 102 and a tubular structure 104 mounted on the frame 102.

The frame 102 comprises a base 106 and frame sections 108, 110 and 112. The frame section 108 is fixed to the base 106. The frame section 112 is slidable with respect to the frame section 110 which is itself slidable with respect to the frame section 108. Thereby, the frame sections 108, 110 and 112 are capable of adopting a retracted position and an extended position in which the frame 102 occupies more space than in the retracted position. In FIG. 1, the frame 102 is shown in the extended position.

According to an embodiment, a U-shaped arm 114 is transversally mounted on the upper frame section 112 at an upper end thereof. The U-shaped arm 114 is opposite the base 106 and defines the volume of the bag. On the U-shaped arm 114 a controller 116 and a handle 118 are fixed. Alternatively, the handle 118 can be slidably mounted to the U-shaped arm 114 or to another part of the frame 102.

According to an embodiment, a pair of wheels 120 is pivotally coupled to the base 106. The handle 118 and the wheels 120 allow rolling (i.e., moving) the bag easy for transportation.

The tubular structure 104 is designed for hanging garments or sports equipment such as jerseys, shoes, skates, socks, pants, hats, wetsuits, bodyskins, bodysuits, helmets, shoulder pads, elbow pads, mouth guards, protective gloves, heavily padded shorts (also known as hockey pants), athletic cup/jock straps, shin pads, neck protectors, neck guards, chest protectors, blockers, catch gloves, leg pads or the like.

The tubular structure 104 comprises a network of tube sections 122, 124, 126 and 130 connected together in which air can be blown. The air can be heated or mixed with a vapor of fragrance or disinfectant (also referred to herein as an odoriferous composition and a disinfectant composition, respectively). At given locations air outputs 128 provide gas exhausts for drying or disinfecting garments or sport equipment hung to the tubular structure 104.

The tube section 124 can pivot with respect the tube section 122 between arms of the tube section 122. The tube sections 122 and 126 can telescopically slide toward the tube section 130. Tubes sections 122, 124 and 126 are capable of adopting a retracted position and an extended position in which the tubular structure 104 occupies more space than in the retracted position. Presently, the tubular structure 104 is shown in the extended position.

A specific tubular structure 104 may be designed for each use the bag. For example, a hockey player's equipment is quite different from the equipment of a football player. In each case, each piece of equipment has its location adapted for it. In each case, the tubular structure 104 is adapted to provide best drying performance and to occupy less space possible. Thereby, such a bag makes it easier for a user to check for the presence of his equipment. Pictograms, not shown, are fixed at accurate locations on the internal structure 100 for precisely identifying storing location of each piece of equipment. This allows a user to easily take stock of his equipment and prevents him from forgetting an item of equipment.

On the frame 102, more precisely on the frame section 108, is mounted a blower 132. The blower 132 as an input 134 for vacuuming air from outside the bag and an output 136. The output 136 is fluidly connected to an air input 138 of the tube sections 130 for blowing air everywhere in the tubular structure 104. Optionally the blower 132 comprises a heating means for heating air or a dispensing means for dispensing vapor or micro drops of fragrance or disinfectant. A disinfectant dispenser allows disinfecting garments or sports equipment alternatively during the drying or during a specific disinfectant program. An odor dispenser may also be provided for dispensing an odoriferous composition to the garments or sports equipment.

The blower 132 provides an air pressure to the air input 138 which is controllable by the controller 116. The blower 132 is controlled by the controller 116 which measures temperature and hygrometry inside the bag and switches modules of the blower 132 on and off depending on given instructions.

A power supply 140 is also mounted on the frame 102, more precisely on the frame section 108. The power supply 140 optionally comprises a battery pack for independently providing electrical power to the blower 132. The power supply 140 alternatively comprises a releasable connection (e.g., electrical cord) for connecting to a building outlet. Optionally, the blower 132, its power supply 140 and its controller 116 can be comprised in an external unit separated from the bag. The external unit can be connected to the bag by a flexible pipe.

Figure 2:
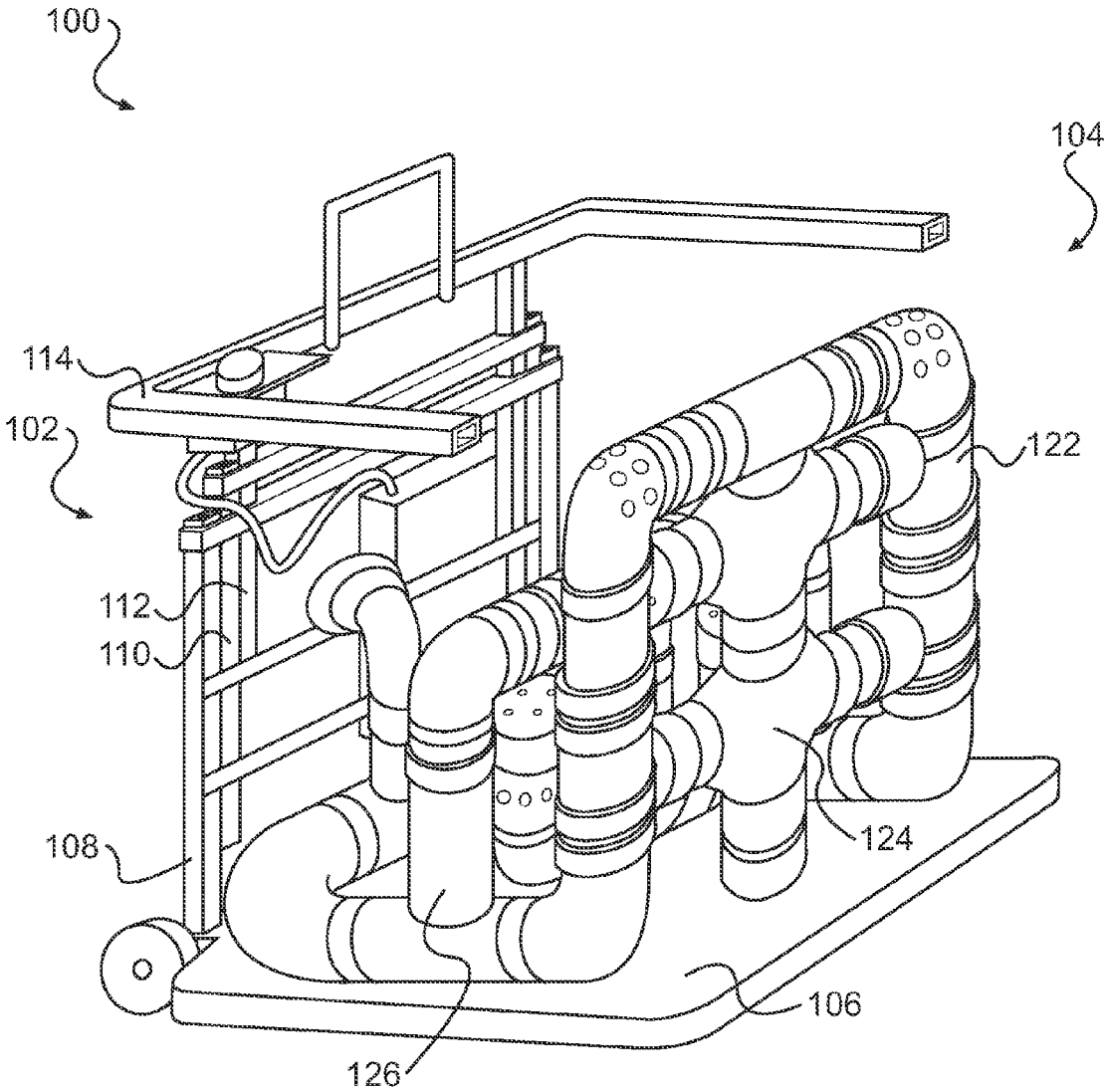
FIG. 2 is a perspective view of the portion of the bag of FIG. 1 in a retracted position.

Referring to FIG. 2, there is shown the internal structure 100 of the bag in the retracted position. The frame sections 108, 110 and 112 are collapsed into each other and folded toward each other thereby reducing the space occupied by the frame 102. A space defined by the base 106 opposite the U-shaped arm 114 is reduced compared with the space similarly defined but in the extended position, as shown on FIG. 1. Also, the tube sections 122, 124 and 126 are collapsed into each other and fold toward each other thereby reducing the space occupied by the tubular structure 104. Tube section 124 has been collapsed and pivoted between arms of the tube section 122.

Figure 4:
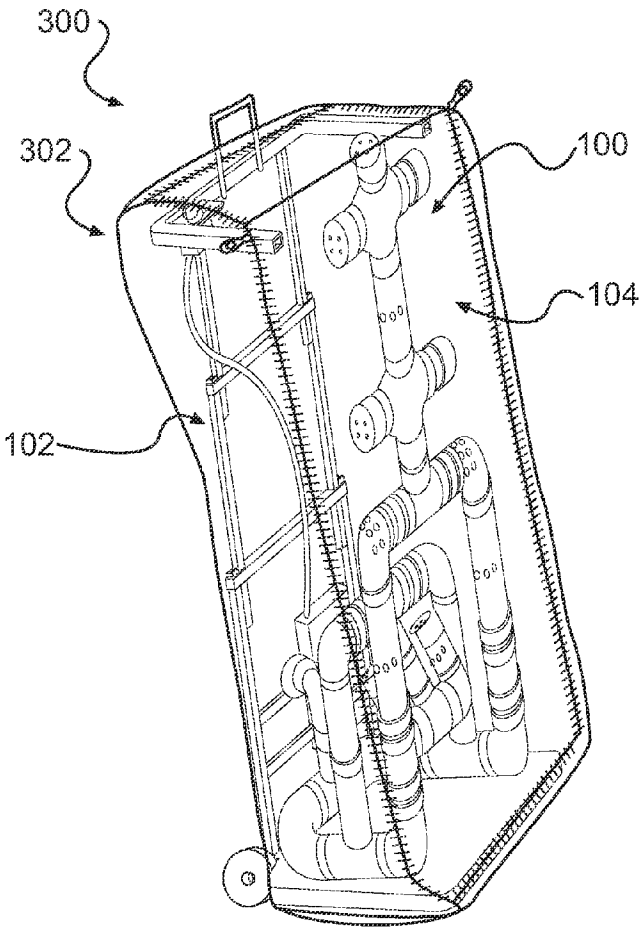
FIG. 4 is a perspective view from the exterior of the bag of FIG. 3 showing its external envelope partially in transparency.
Figure 3:
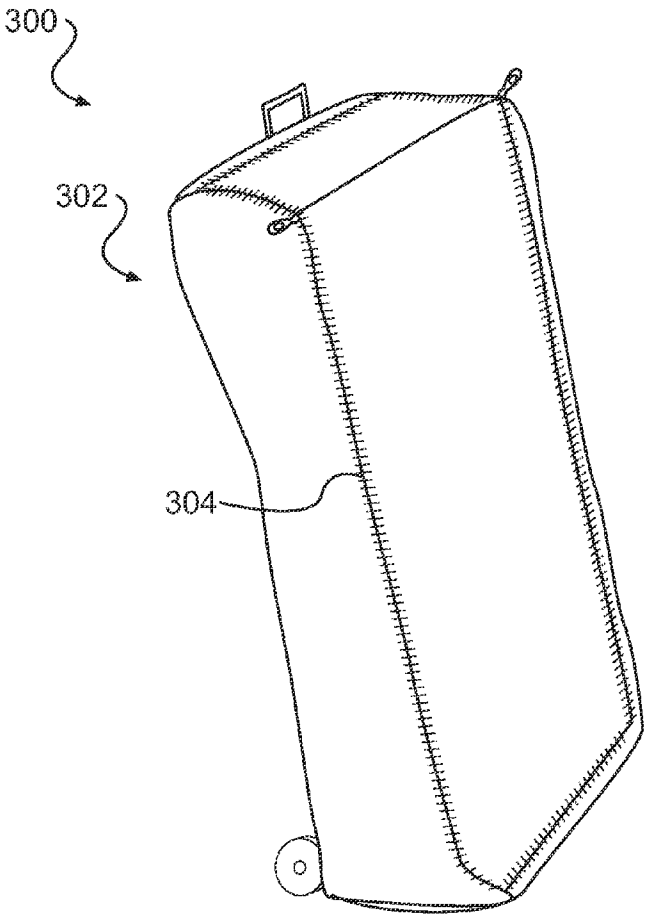
FIG. 3 is a perspective view of the exterior of the bag in the extended position.

Concurrently referring to FIG. 3 and FIG. 4, there is shown a bag 300 comprising an external envelope 302 and the internal structure 100 inside the envelope, in the extended position. The frame 102, especially the base 106 and the U-shaped arm 114 support the external envelope 302. The external envelope 302 is made of a flexible resistant material for being folded and unfolded and for staying in good condition after some years of rough usage. Located at a hidden face of the bag 300, the envelope comprises an air entry port for proving fresh air to the blower 132 via the input 134 of the blower 132.

A zipper 304 runs around the envelope 302 for opening the envelope 302 and providing an access inside the bag and to the tubular structure to install and remove garments or sports equipment. Any other type of fastener, such as buttons or Velcro™, can be used to replace or complement zipper 304. In the extended position, the bag 300 contains all the equipment for drying and for storing awaiting the next use. It is envisioned that returning form a competition, equipment is washed and directly put in the bag 300 for drying. The bag 300 is advantageous because no other support or arrangement is necessary and no additional space is necessary.

Figure 5:
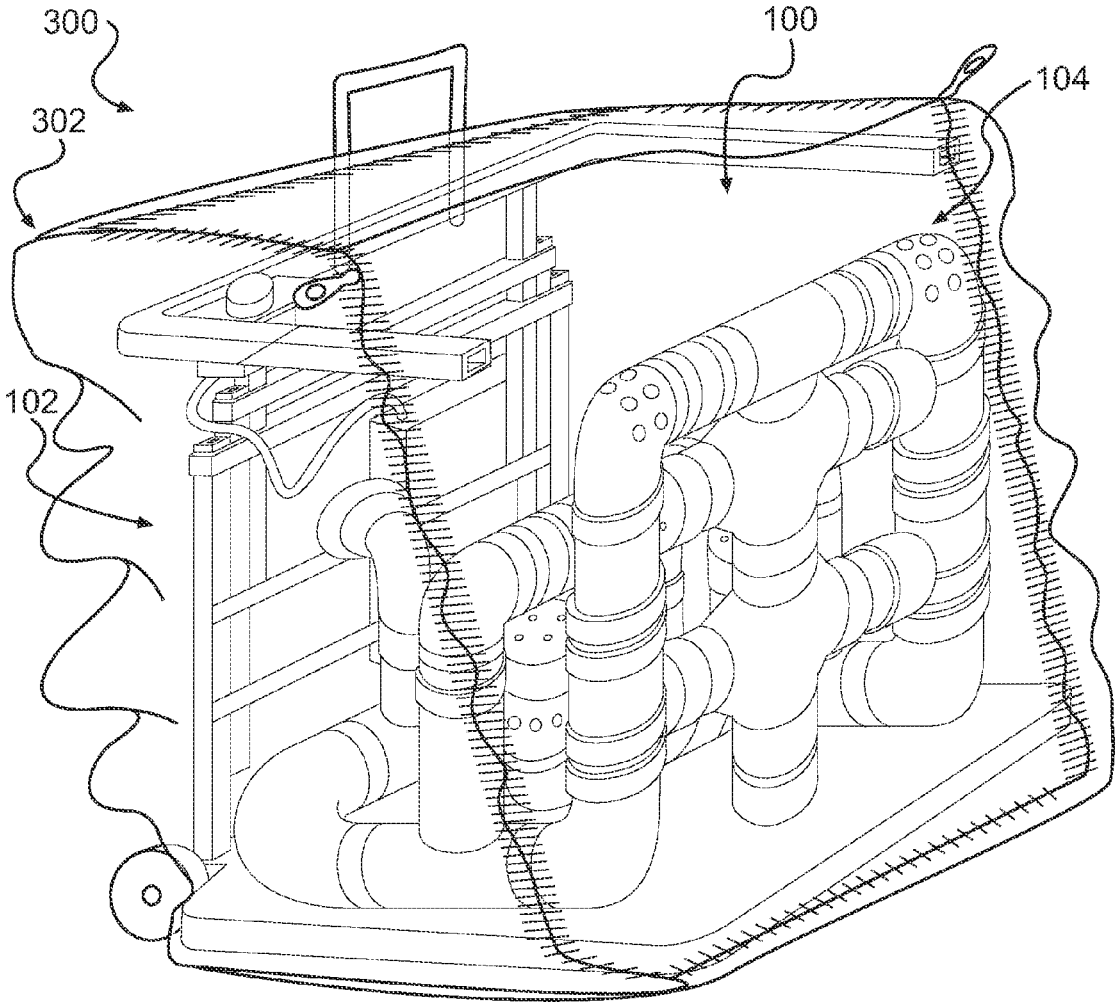
FIG. 5 is a perspective view from the exterior of the bag of FIG. 3 in a retracted position, showing its external envelope partially in transparency.

In FIG. 5, there is shown the bag 300 in the retracted position. The frame 102 and the tubular structure 104 are collapsed. The external envelope 302 is folded around the internal structure 100 not to significantly exceed the volume of the frame 102 in the retracted position. The retracted position of the bag 300 is advantageous especially in changing rooms while the equipment is worn. There are generally no specific lockers and not enough space to comfortably contain bags for a whole team. The retracted position allows putting the bag 300 under benches thereby making circulation easier in the room.

While preferred embodiments have been described above and illustrated in the accompanying drawings, it will be evident to those skilled in the art that modifications may be made therein without departing from the essence of this disclosure. Such modifications are considered as possible variants comprised in the scope of the disclosure.

The invention claimed is:

1. A bag for storing and drying garments or sports equipment, the bag comprising:

an external envelope substantially made of flexible resistant material;

a frame supporting the external envelope and comprising frame sections capable of adopting a retracted position and an extended position in which the frame occupies more space than in the retracted position; and a tubular structure for hanging the garments or sports equipment and through which air can be blown for drying the hung garments or sports equipment, the tubular structure being mounted on the frame and comprising tube sections capable of adopting a retracted position and an extended position in which the tubular structure occupies more space than in the retracted position.

2. The bag of claim 1, wherein the tubular structure comprises an air input and a plurality of air outputs for blowing air on the garments or sports equipment.

3. The bag of claim 2, further comprising a blower mounted to the frame and connected to the air input of the tubular structure for providing the blown air.

4. The bag of claim 3, further comprising a controller electrically connected to the blower for controlling at least one of air pressure and air temperature.

5. The bag of claim 3, wherein the external envelope comprises an air entry port for providing fresh air to the blower.

6. The bag of claim 3, further comprising a battery pack mounted to the frame for providing electrical power to the blower.

7. The bag of claim 3, further comprising an electrical cord for connecting the blower to an electrical outlet for providing electrical power to the blower.

8. The bag of claim 1, wherein the frame comprises a U-shaped arm at an upper end thereof for providing additional support to the external envelope.

9. The bag of claim 1, wherein the frame sections are capable of at least one of: collapsing into or along each other and folding toward each other thereby changing the space occupied by the frame.

10. The bag of claim 1, wherein the tube sections are capable of at least one of: collapsing into or along each other and folding toward each other thereby changing the space occupied by the tubular structure.

11. The bag of claim 1, further comprising wheels mounted to the frame.

12. The bag of claim 1, further comprising a handle mounted to one of the frame and the external envelope at a portion of the bag substantially opposite the wheels to facilitate moving of the bag.

13. The bag of claim 1, further comprising a disinfectant dispenser for dispensing a disinfectant composition to the garments or sports equipment.

14. The bag of claim 13, wherein the disinfectant dispenser is adapted to dispense the disinfectant composition through the tubular structure.

15. The bag of claim 1, further comprising an odor dispenser for dispensing an odoriferous composition to the garments or sports equipment.

16. The bag of claim 13, wherein the odor dispenser is adapted to dispense the odoriferous composition through the tubular structure.

* * * * *